US005615716A

United States Patent [19]

Akazawa

[11] Patent Number: 5,615,716

[45] Date of Patent: Apr. 1, 1997

[54] ENGINE COOLANT CHANGING APPARATUS

[76] Inventor: Yasumasa Akazawa, 2-8-14 Higashi-shinmachi, Matsubara shi, Osaka, Japan

[21] Appl. No.: 607,995

[22] Filed: Mar. 4, 1996

Related U.S. Application Data

[62] Division of Ser. No. 373,136, Jan. 17, 1995, Pat. No. 5,573,045.

[30] Foreign Application Priority Data

Dec. 15, 1994 [JP] Japan ..... 6-333900

[51] Int. Cl.[6] ..... B65B 3/00

[52] U.S. Cl. ..... 141/91; 141/59; 141/65; 141/67; 134/169 A; 165/95

[58] Field of Search ..... 141/59, 65, 67, 141/91, 92, 98; 134/169 A; 165/95

[56] References Cited

U.S. PATENT DOCUMENTS 5,265,653 11/1993 Herlth ..... 141/65

5,329,982 7/1994 Payne ..... 165/95 X 5,370,160 12/1994 Parker ..... 141/98

5,415,247 5/1995 Knorr ..... 141/65 X

*Primary Examiner*—J. Casimer Jacyna

*Attorney, Agent, or Firm*—Moonray Kojima

[57] ABSTRACT

The invention relates to an engine coolant changing apparatus for changing an engine coolant such as LLC (long-life coolant) in an engine coolant path containing a radiator, comprising coolant storing means possessing a pressure action port and a liquid inlet and outlet, detaching mechanism to be attached or detached to or from a filler port of a radiator, communicating device for communicating between the liquid inlet and outlet and the detaching device, and pressure action device for applying a negative pressure to the pressure action port to overheat the coolant to a low temperature by driving an engine when discharging the coolant from an engine coolant system, and applying a positive pressure to the pressure action port when feeding a fresh liquid, so that the coolant can be changed promptly in a short time, without requiring manipulation of radiator drain cock or jack-up of the vehicle.

2 Claims, 19 Drawing Sheets

ENGINE COOLANT CHANGING APPARATUS

This is a division of application Ser. No. 08/373,136, filed Jan. 17, 1995, now U.S. Pat. No. 5,573,045.

SUMMARY OF THE INVENTION

The present invention relates to an apparatus for changing engine coolant such as LLC (long-life coolant) in an engine coolant passage including radiator, comprising coolant storing means possessing a pressure action port and liquid inlet and outlet, detaching means for attaching and detaching to and from a filler port of a radiator, communicating means for communicating between the liquid inlet and outlet and the detaching means, and pressure action means for applying a negative pressure to the pressure action port to overheat the coolant to a low temperature by driving the engine when discharging the coolant from the engine coolant passage, and applying a positive pressure to the pressure action port when feeding fresh coolant, so that the coolant may be changed quickly in a short time without requiring manipulation of radiator drain cock or jack-up operation of the vehicle.

BACKGROUND OF THE INVENTION

Generally, to change an engine coolant, the radiator drain cock is opened, and the coolant is discharged, but since the radiator drain cock is located in a lower position of the engine room, it is extremely hard to handle the drain cock, and complicated operations such as jack-up of vehicle were required.

A conventional constitution of such coolant changing apparatus is disclosed, for example, in the Japanese Laid-open Utility Model No. 4-66323.

That is, it relates to a radiator washing tank comprising a tank main body for accommodating a specified volume of liquid, a liquid feed port provided at the upper end of the tank main body, an opening valve in the lower part, a fitting cap detachably fitted to the filler port on the radiator upper tank provided at the lower end, and an air vent pipe opened near the opening valve at the lower end and opened above the tank main body at the upper end.

In this radiator washing tank, after discharging the liquid in the radiator by opening the drain cock of the drain port located below the lower tank of the radiator or at the side of the lower tank, the drain cock is closed, the filler cap of the filler port provided in the radiator upper tank is removed, the fitting cap at the lower end of the tank main body is fitted to the filler port opened by removing the filler cap by one-touch operation, the opening valve is opened, the liquid is fed in through the feed port of a relatively wide opening area at the upper end of the tank main body, then the liquid in the tank main body flows down by gravity, while the air in the radiator is released to the atmosphere through the upper opening of the tank main body through the air vent valve, and therefore the liquid in the tank flows smoothly into the radiator while releasing air, thereby washing the radiator and changing oil easily, and hence the job efficiency of washing and liquid change is enhanced, and the liquid feeding performance is notably improved, whereas the following problems existed.

Depending on the flow-down by gravity, the conventional apparatus took about 10 and 20 minutes to change oil, and the oil change efficiency was poor. In addition, it needed opening and closing of the radiator drain cock, and the same problems as mentioned above were not solved.

OBJECT OF THE INVENTION

It is hence a primary object of the invention to present an engine coolant changing apparatus capable of discharging the coolant and bubbles in an extremely short time by setting the engine coolant passage in a negative pressure and overheating the coolant to low temperature by heat by driving the engine to keep an overheat state artificially, and feeding a fresh liquid quickly in an extremely short time by pressure difference by feeding the fresh liquid kept in a positive pressure into the engine coolant passage kept in a negative pressure, without having to manipulate the radiator drain cock or jack up the vehicle.

It is other object of the invention to present an engine coolant changing apparatus capable of discharging the coolant, feeding fresh liquid, and releasing and recovering the discharged coolant into recovery means smoothly by single means for storing the coolant, thereby simplifying the apparatus, by installing specific path changeover means on the way of communicating means for communicating between the liquid inlet and outlet of the coolant storing means and detaching means to be attached or detached to or form the filler port of a radiator.

It is another object of the invention to present an engine coolant changing apparatus capable of discharging the coolant and bubbles in an extremely short time in waste liquid storing means by setting the engine coolant passage in a negative pressure and overheating the coolant to low temperature by heat by driving the engine to keep an overheat state artificially, and feeding a fresh liquid quickly in an extremely short time by pressure difference by feeding the fresh liquid kept in a positive pressure from fresh liquid storing means into the engine coolant passage kept in a negative pressure, without having to manipulate the radiator drain cock or jack up the vehicle.

It is a different object of the invention to present an engine coolant changing apparatus capable of simplifying the apparatus, avoiding combined use of vacuum suction means such as vacuum pump and air compressing means, by constituting pressure action means as positive and negative pressure generating source by using single means for compressing air, by constituting the pressure action means with air pressure means such as air compressor and pressure changing means such as specific air ejector.

It is other different object of the invention to present an engine coolant changing apparatus capable of enhancing the negative pressure suction effect of the coolant, by installing a member for directly sucking the coolant from the upper end opening of a water tube opened in a radiator upper tan.

It is a further different object of the invention to present an engine coolant changing apparatus capable of preventing the coolant from staying on the way, by installing a member for sucking the coolant between the upper end of a water tube slightly projecting into the radiator upper tank and the upper plate.

Other objects and features of the invention will be better appreciated and understood from the following detailed description of embodiments taken in conjunction with the accompanying drawings.

EMBODIMENTS

Figure 1:
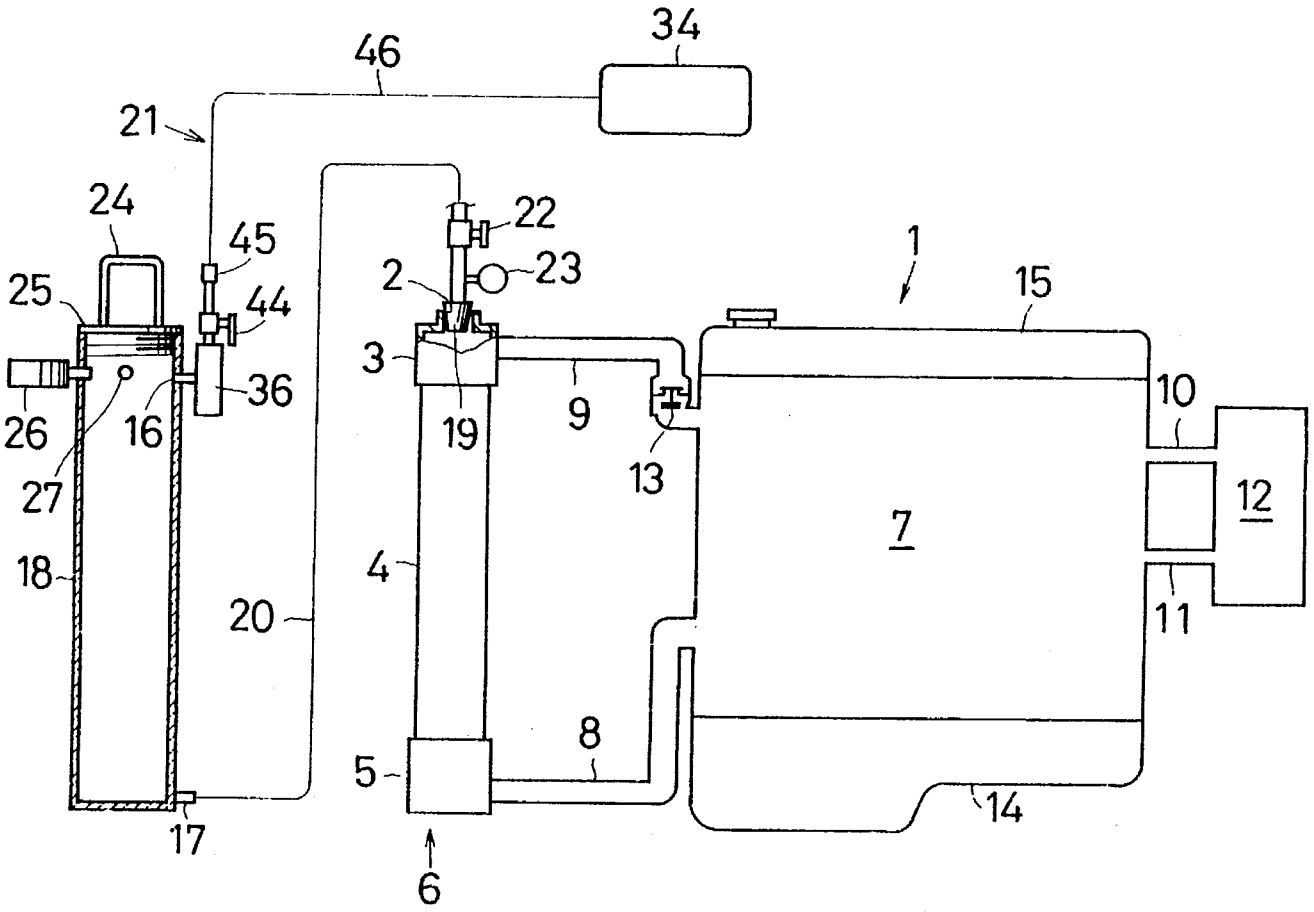
FIG. 1 is a block diagram showing a first embodiment of an engine coolant changing apparatus of the invention.

Some of the embodiments of the invention are described below while referring to the drawings.

(First Embodiment)

The drawings how an engine coolant changing apparatus, and referring first to FIG. 1, the constitution of an engine coolant system 1 is described; that is, a radiator 6 is provided as cooling means by comprising an upper tank 3 having a filler port 2 at the upper end, a radiator core 4, and a lower tank 5, the lower tank 5 of the radiator 6, and various water jackets 7 at the engine side are communicated and connected through outlet lines 8 such as outlet hoses, the water jackets 7 and the upper tank 3 of the radiator 6 are communicated and connected through inlet lines 9 such as inlet hoses, and the water jackets 7 and air-conditioning heater core 12 are communicated and connected through communicating paths 10, 11, thereby constituting the engine coolant system 1.

In the engine of engine coolant outlet control type, a thermostat valve 13 is disposed in the inlet line 9. In FIG. 1, moreover, reference numeral 14 denotes an oil pan, and 15 is a cylinder head cover. The water jacket 7 is actually constituted in a complicated form in relation to the cylinder block and cylinder head, but it is simplified in FIG. 1.

Figure 2:
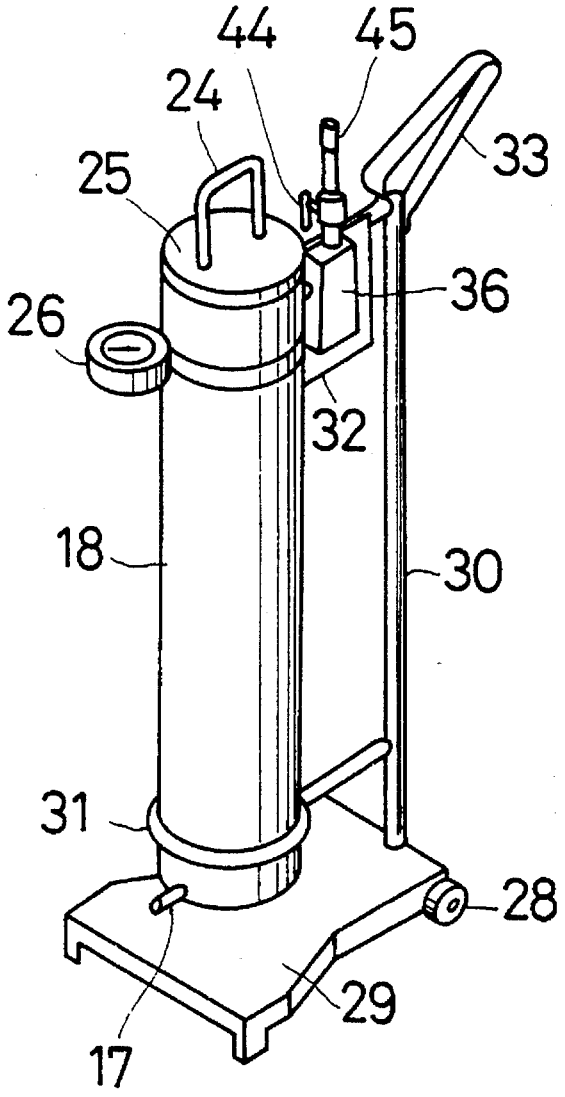
FIG. 2 is a perspective view of the engine coolant changing apparatus in FIG. 1.

An engine coolant changing apparatus for changing the coolant (cooling water, LLC, etc.) in the engine coolant system 1 is constituted as shown in FIGS. 1 and 2.

That is, this engine coolant changing apparatus comprises a transparent or translucent tank 18 as coolant storing means having a pressure action port 16 in the upper part and a liquid inlet and outlet 17 in the lower part;

a rubber plug 19 forming the outline in a taper cone shape, having a passage inside as detaching means for attaching or detaching to or from the filler port 2 air-tightly and liquid-tightly, after removing the filler cap or the filler port 2 of the radiator;

a flexible hose 20 as communicating means between the liquid inlet and outlet 17 of the tank 18 and the rubber plug 19; and pressure action means 21 for applying a negative pressure to the pressure action port 16 to overheat the coolant to a low temperature by driving the engine when discharging the coolant from the engine coolant system 1, and applying a positive pressure (including an atmospheric pressure) to the pressure action port 16 when feeding fresh liquid.

Near the rubber plug 19, herein, a cock 22 is disposed as opening and closing means for holding the negative pressure, and between this cock 22 and rubber plug 19, a negative pressure meter 23 is provided as fail detecting means for detecting leak of the engine coolant system 1 between the cock 22 and rubber plug 19.

The upper end opening of the tank 18 is detachably closed air-tightly by a lid member 25 having a handle 24, and a pressure meter 26 for both positive pressure and negative pressure for detecting the tank internal pressure, and a pressure valve 27 as safety means for closing the valve when the tank internal pressure exceeds a specific high pressure are provided in the upper part of the tank 18.

The tank 18 is mounted, as shown in FIG. 2, on a portable carriage 29 having wheels 28, 28 at least at one side. The carriage 29 has an upright stand 30, and a holding ring 31 for holding the lower part of the tank 18 is provided in the lower region of the stand 30, while a mounting plate 32 for mounting an air ejector 36 described later and a handle member 33 serving also as stopping member of the hose 20 are provided in the upper part.

Figure 3:
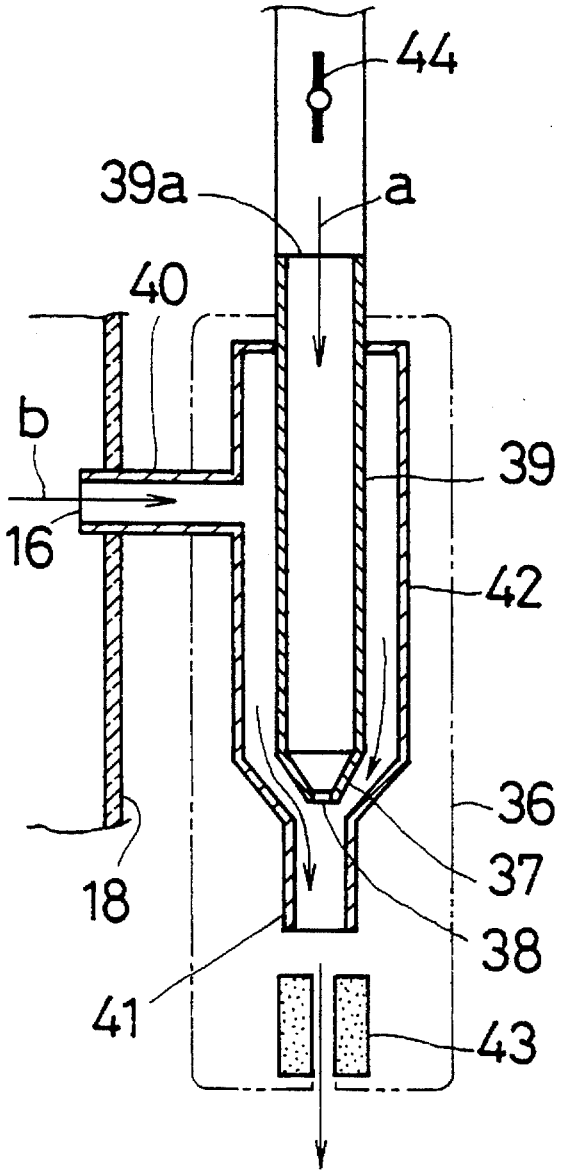
FIG. 3 is an explanatory diagram of negative pressure action by an air ejector.
Figure 4:
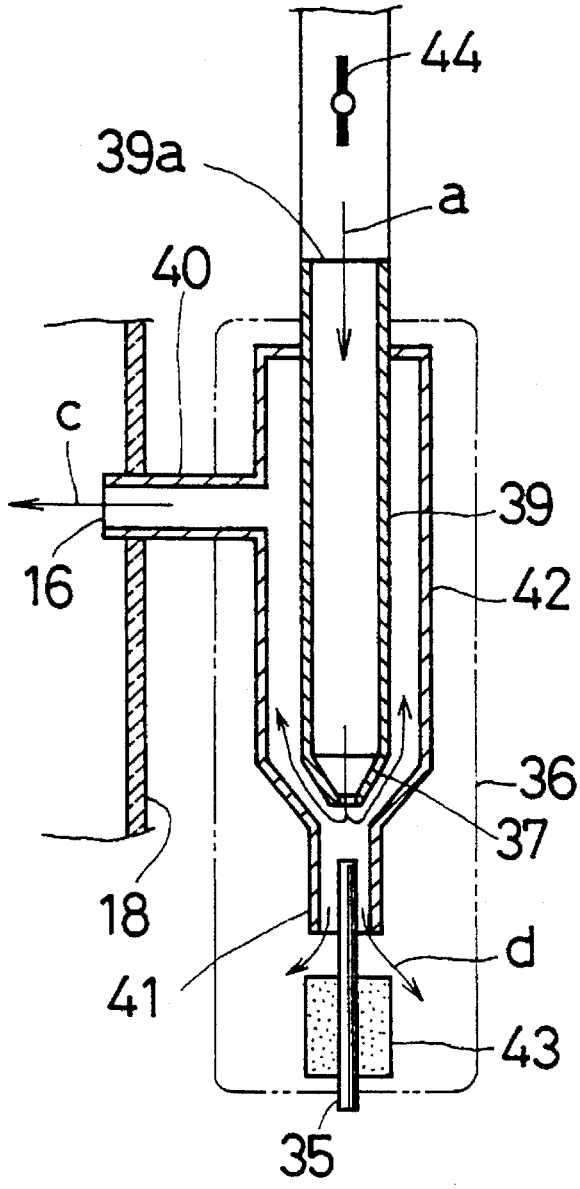
FIG. 4 is an explanatory diagram of positive pressure action by an air ejector.

Referring next to FIGS. 1, 3 and 4, a specific constitution of the pressure action means 21 is described below.

This pressure action means 21 comprises an air compressor 34 as air compressing means, and an air ejector 36 as pressure changeover means for applying a drive flow from the air compressor as a primary flow a and a negative pressure as a secondary flow b to the pressure action port 16, and applying a positive pressure to the pressure action port 16 when a resistance is added by a baffle pin 35 as a resistance addition element to ejection of the drive flow.

The air ejector 36 comprises an inner pipe 39 having an ejection port 38 at the front end of a nozzle 37, and an outer pipe 42 having a secondary flow forming pipe 40 and a mixed flow outlet 41, and a holding member 43 of the baffle pin 35 is formed at the position confronting the mixed flow outlet 41, the secondary flow forming pipe 40 communicates with the pressure action port 16 in the tank 18, while a drive flow inlet **39*a* of the inner pipe 39 communicates with a compressed air discharge part of the air compressor 34 through an opening valve 44, a connector 45, and a flexible hose 46. It may be also constituted to adjust the pressure of the drive flow by placing a pressure control vavle (not shown) between the opening valve 44 and drive flow inlet 39*a***.

In the air ejector, as shown in FIG. 3, when the baffle pin 35 is not inserted in the holding member 43, that is, when the mixed flow outlet 41 is fully opened to the atmosphere, the high speed flow from the air compressor 34 is ejected from the ejection port 38 as the primary flow a, and the secondary flow b is sucked into a mixing chamber, and therefore a negative pressure acts on the pressure action port 16, and as shown in FIG. 4, on the other hand, when the baffle pin 35 is inserted into the holding member 43 and the mixed flow outlet 41 is partially closed, part of the ejection flow ejecting from the ejection port 38 flows back into the pressure action port 16 from the secondary flow forming pipe 40 by the resistance of the baffle pin 35, and a positive pressure c acts on the pressure action port 16. Or, incidentally, if the mixed flow outlet 41 is fully closed, the positive pressure c flowing back into the pressure action port 16 is too strong, and part d is released to the atmosphere.

In thus constituted embodiment, the action is described below.

Figure 5:
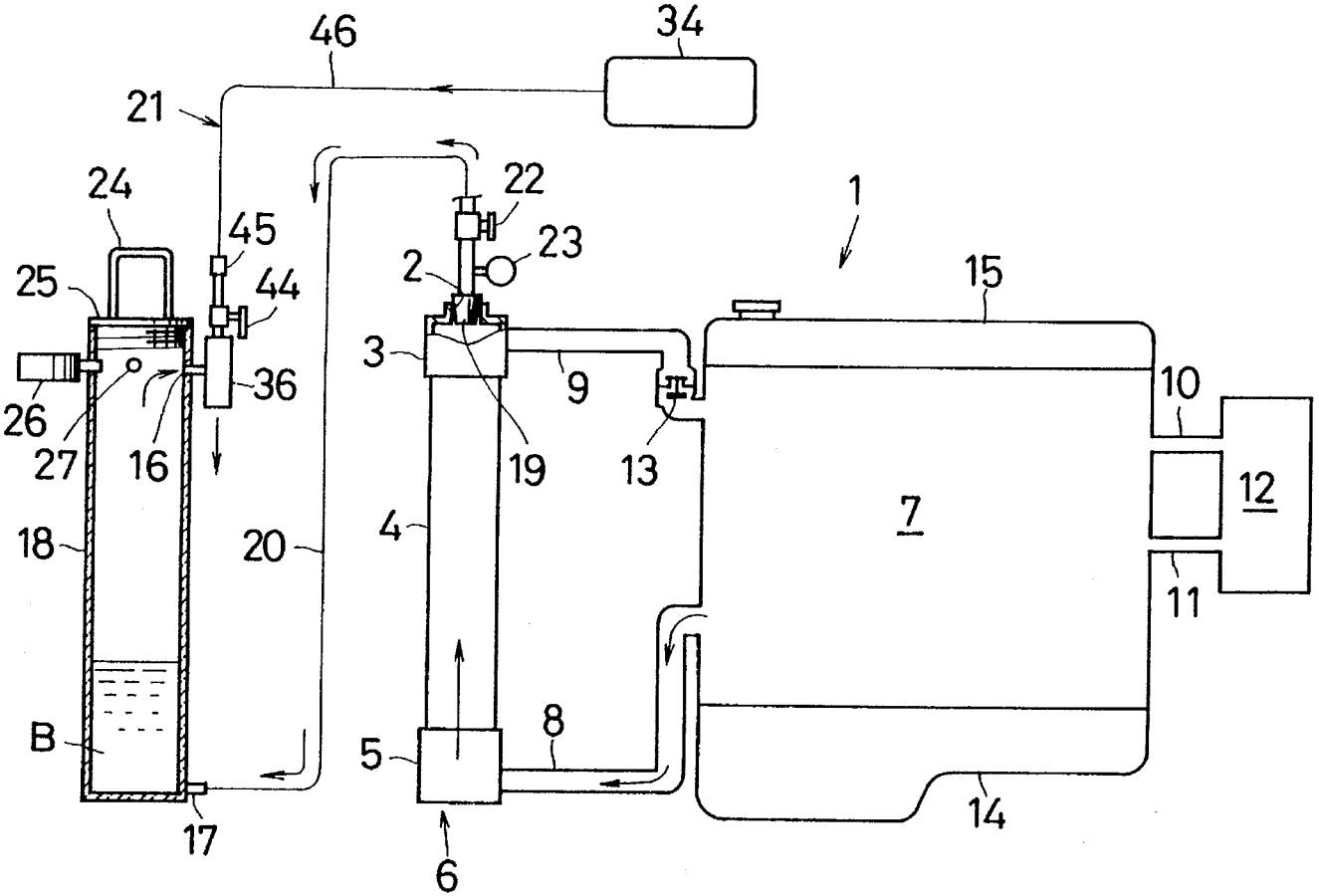
FIG. 5 is an explanatory diagram of coolant discharge.

To discharge the coolant such as LLC from the engine coolant system 1, first as shown in FIG. 5, the rubber plug 19 is fitted air-tightly to the filler port 2 of the radiator 6, and the cock 22 and opening valve 44 are opened, the air ejector 36 is set in the state shown in FIG. 3, the air compressor 34 is driven to apply a negative pressure to the pressure action port 16 of the tank 18, and the engine is driven. In the case of the constitution with the thermostat valve 13 of outlet control type, it is handled below the temperature (82° to 88° C.) for opening the thermostat valve 13. That is, it is handled with the thermostat valve 13 in closed state.

In thus engine driven state, when a negative pressure (for example, reduced to 500 mmHg or more) is applied into the engine coolant system 1 through elements 16, 18, 17, 20, 22, and 19, the boiling point of the coolant is lowered, and therefore the coolant in the engine coolant system 1 is overheated to low temperature by the engine heat, and boils in a so-called artificial overheat state, and the coolant is pressurized by the generated bubbles, and hence by the negative pressure acting in the tank 18, almost whole coolant in the engine coolant system 1 and its bubbles can be effectively discharged in an extremely short time into the tank 18 in the sequence of the elements 19, 22, 20, and 17. Moreover, since the tank 18 is transparent or translucent, degree of contamination of waste liquid B can be known at a glance.

The moment the waste liquid B of the coolant is discharged into the tank 18, the cock 22 is closed, and the engine coolant system 1 is held in a negative pressure. At this time, if there is any defective point (water leak point) in the engine coolant system 1, air flows in from this portion, and hence it can be detected by the negative pressure meter 23.

Figure 6:
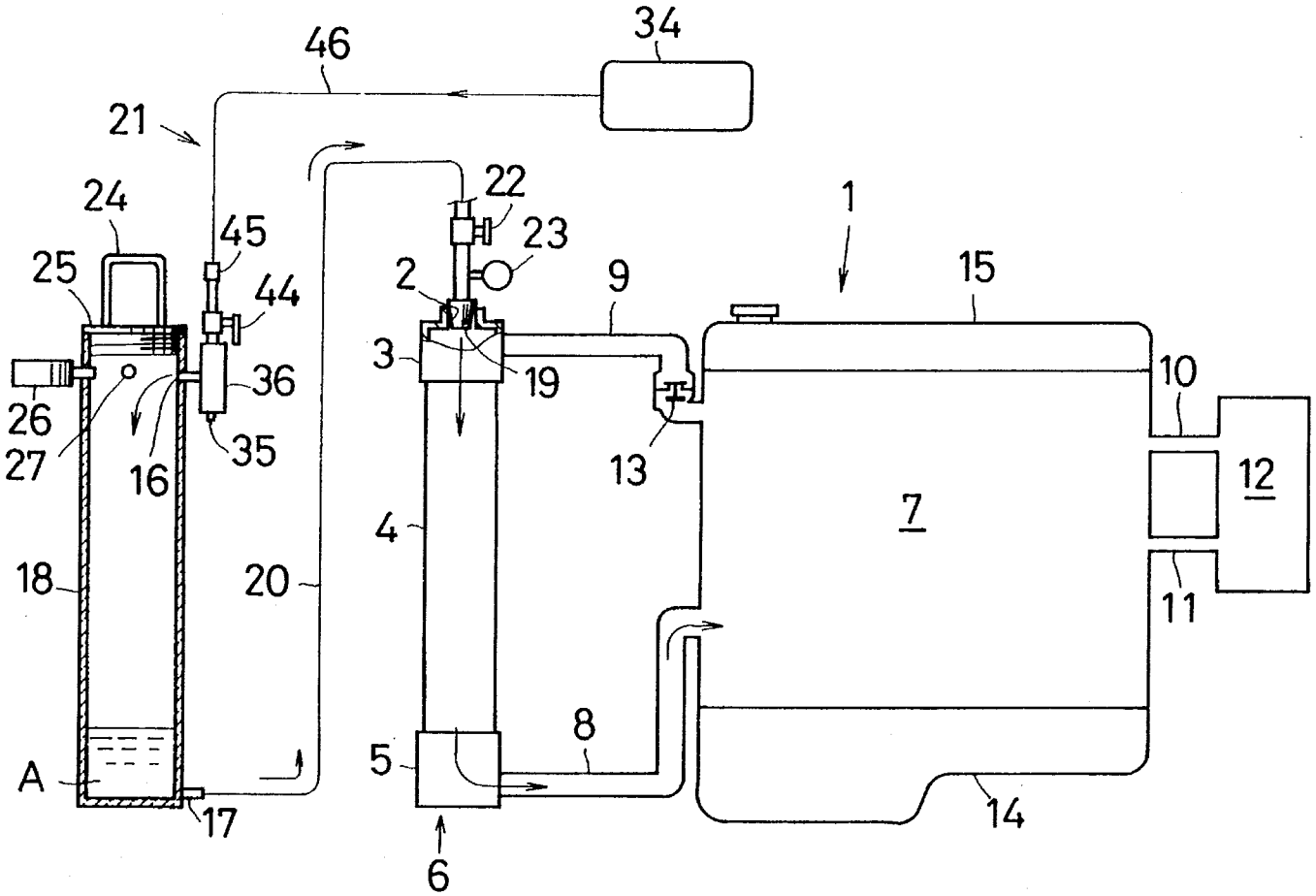
FIG. 6 is an explanatory diagram of fresh liquid feed.

When feeding fresh liquid such as LLC into the engine coolant system 1, the waste liquid B in the tank 18 shown in FIG. 5 is first released into recovery means such as waste liquid recovery tank, and fresh liquid B is stored in the tank 18 as shown in FIG. 6.

Consequently, setting the air ejector 36 in the state in FIG. 4, the cock 22 and opening valve 44 are opened, and when the air compressor 34 is driven to apply a positive pressure to the pressure action port 16 of the tank 18, the fresh liquid A kept in positive pressure is supplied into the engine coolant system 1 held in a negative pressure in the sequence of elements 17, 20, 22, and 19, so that the fresh liquid A can be promptly supplied in an extremely short time by the pressure difference.

Moreover, unlike the prior art, it is not necessary to manipulate the radiator drain cock or the like or jack up the vehicle, so that the efficiency of engine coolant changing job can be notably enhanced.

In addition, since the pressure action means is composed of air compressing means (see air compressor 34), pressure changeover means (see air ejector 36), and element (see baffle pin 35) for applying resistance to the drive flow ejection portion of the pressure changeover means, when the drive flow ejection portion is released, the high pressure drive flow from the air compressing means is applied as primary flow a, and secondary flow b or negative pressure is applied to the pressure action port 16, and by adding a resistance to the drive flow ejection portion of the pressure changeover means, the primary flow a passing through the drive flow ejection portion flows back into the pressure action port 16, so that a positive pressure is applied to the pressure action port 16.

As a result, the pressure action means as the pressure generating source of positive pressure and negative pressure can be constituted by using only one means for compressing air such as air compressor 34, and therefore combined use of vacuum suction means (vacuum pump, etc.) and air compressing means is avoided, thereby simplifying the apparatus.

Figure 7:
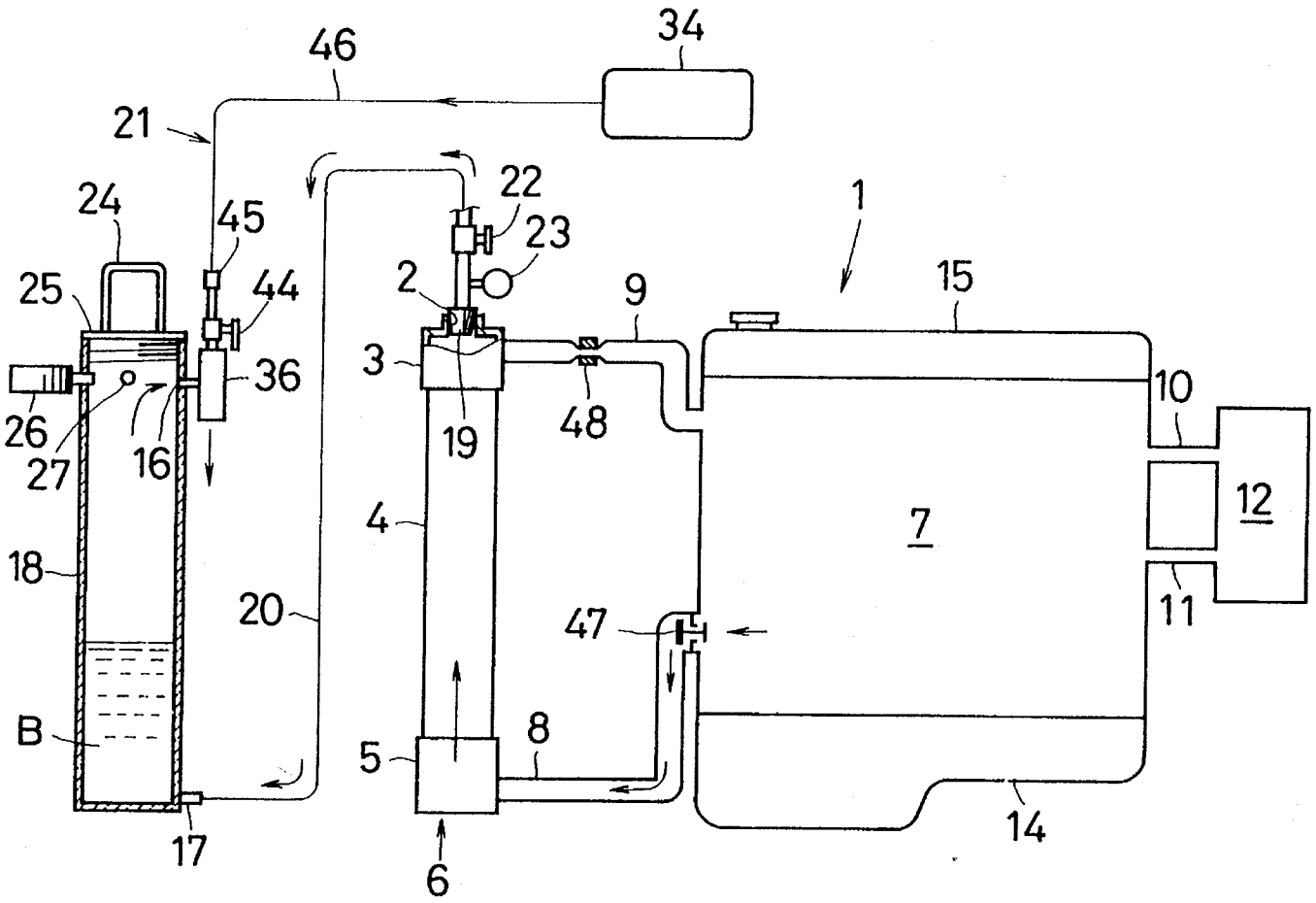
FIG. 7 is an explanatory diagram of coolant discharge in an apparatus having a thermostat valve of inlet control type.

Incidentally, in the engine coolant system 1 having a thermostat valve 47 of inlet control type in the outlet line 8 as shown in FIG. 7, the inlet line 9 is stopped by a stopping member 48 such as band and clip when discharging the waste liquid B, and flow of coolant is arrested, and negative pressure suction of the coolant is executed at a temperature (82° to 88° C.) for opening the thermostat valve 47.

In such constitution, the other points are same as in the foregoing embodiment in both action and effect, and therefore same reference numerals are given to the corresponding parts in FIG. 7 and detailed descriptions are omitted.

(Second Embodiment)

Figure 8:
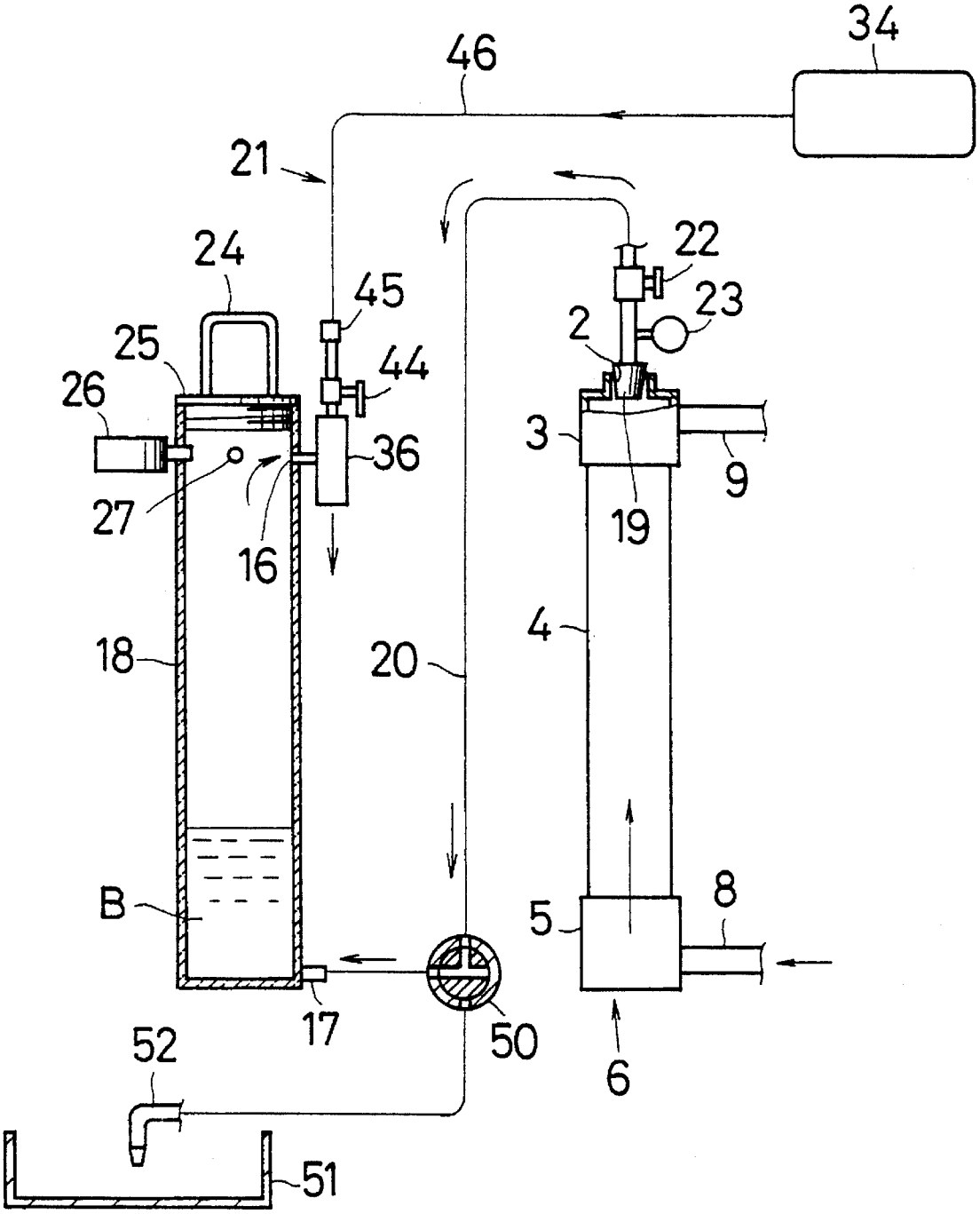
FIG. 8 is an explanatory diagram of coolant discharge in a second embodiment of an engine coolant changing apparatus of the invention.
Figure 9:
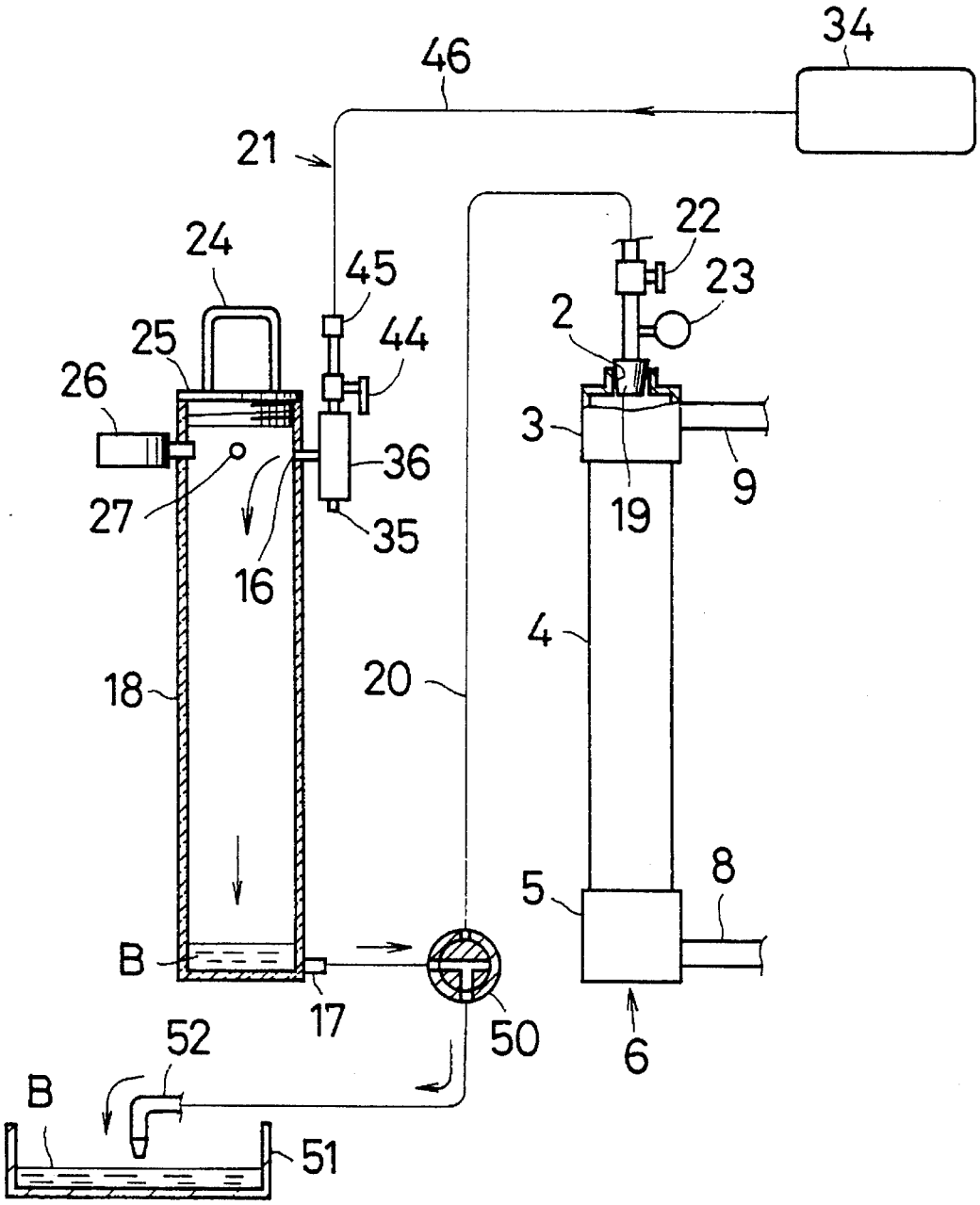
FIG. 9 is an explanatory diagram of coolant recovery in the second embodiment.
Figure 10:
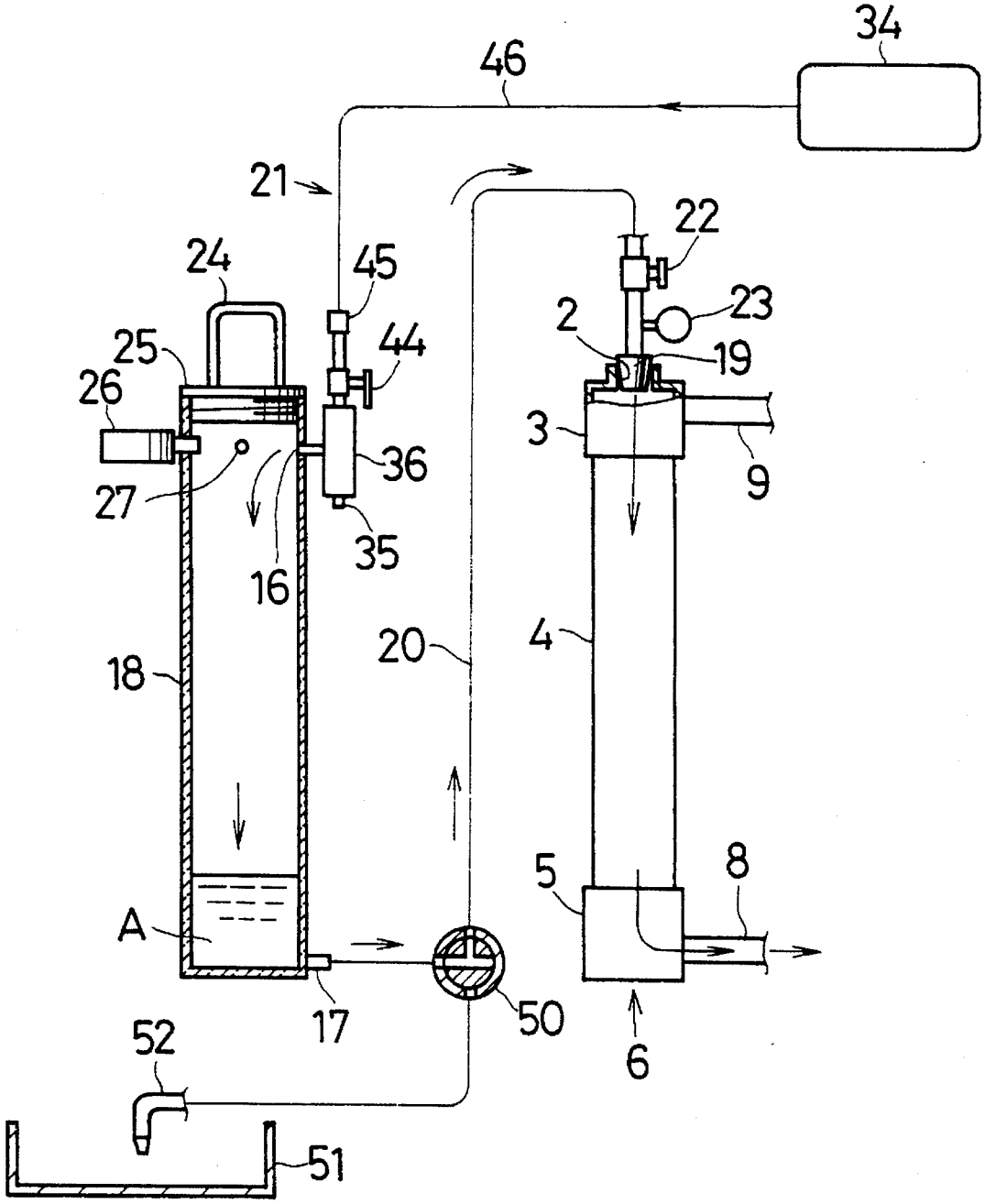
FIG. 10 is an explanatory diagram of fresh liquid feed in the second embodiment.

FIG. 8 to FIG. 10 relate to a second embodiment of an engine coolant changing apparatus, in which a three-way valve 50 is provided as passage changeover means in an intermediate point of a flexible hose 20 as communicating means for communicating between the liquid inlet and outlet 17 of the tank 18 and rubber plug 19, and the liquid inlet and outlet 17 and rubber plug 19 are communicated when discharging the coolant and when feeding fresh liquid, and the liquid inlet and outlet 17 and a recovery hose 52 as recovery passage are communicated when recovering the discharged coolant into a recovery tank 51 as recovery means.

In such constitution, when the rubber plug 19 and liquid inlet and outlet 17 are communicated by the three-way valve 50 as the passage changeover means as shown in FIG. 8, a negative pressure is applied to the pressure action port 16, and the waste liquid can be discharged into the tank 18 through the elements 19, 22, 20, 50, and 17, or when the liquid inlet and outlet 17 and the recovery hose 42 as recovery passage are communicated by the three-way valve 50 as shown in FIG. 9, a positive pressure is applied to the pressure action port 16 and the waste liquid B once discharged into the tank 18 is released and recovered in the recovery tank 51 through the elements 17, 50, 52.

Moreover, after storing fresh liquid A into the once empty tank 18 from the liquid inlet and outlet 17 side or opened lid member 25 side, when the liquid inlet and outlet 17 and rubber plug 19 are communicated by the three-way valve 50 as shown in FIG. 10, a positive pressure is applied to the pressure action port 16, and fresh liquid A can be promptly supplied into the engine coolant system 1 through the elements 17, 50, 20, 22, and 19.

In this way, using the single tank 18 and the single three-way valve 50, discharge of waste liquid B, feed of fresh liquid A, and release and recovery of discharged waste liquid B into recovery tank 51 can be done smoothly, so that the apparatus may be simplified.

In particular, when LLC is used as coolant, Pb (lead) and ethylene glycol are contained in the waste liquid B, and by securely recovering the Pb and ethylene glycol, the environments can be protected.

In the second embodiment, the other points are similar to the first embodiment in action and effect, and same reference numbers as in the previous drawings are given to the corresponding parts in FIG. 8 to FIG. 10, and their detailed description is omitted.

(Third Embodiment)

Figure 11:
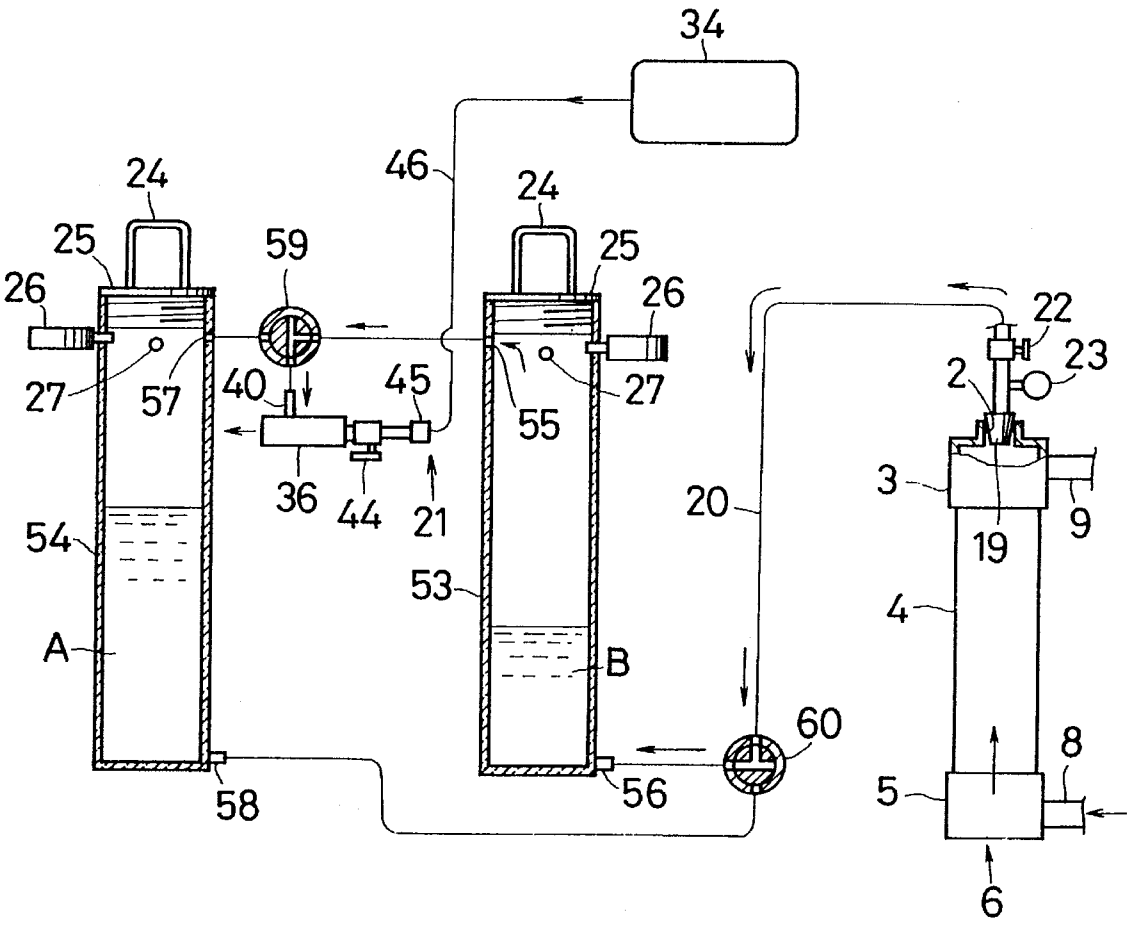
FIG. 11 is an explanatory diagram of coolant discharge in a third embodiment of an engine coolant changing apparatus of the invention.
Figure 12:
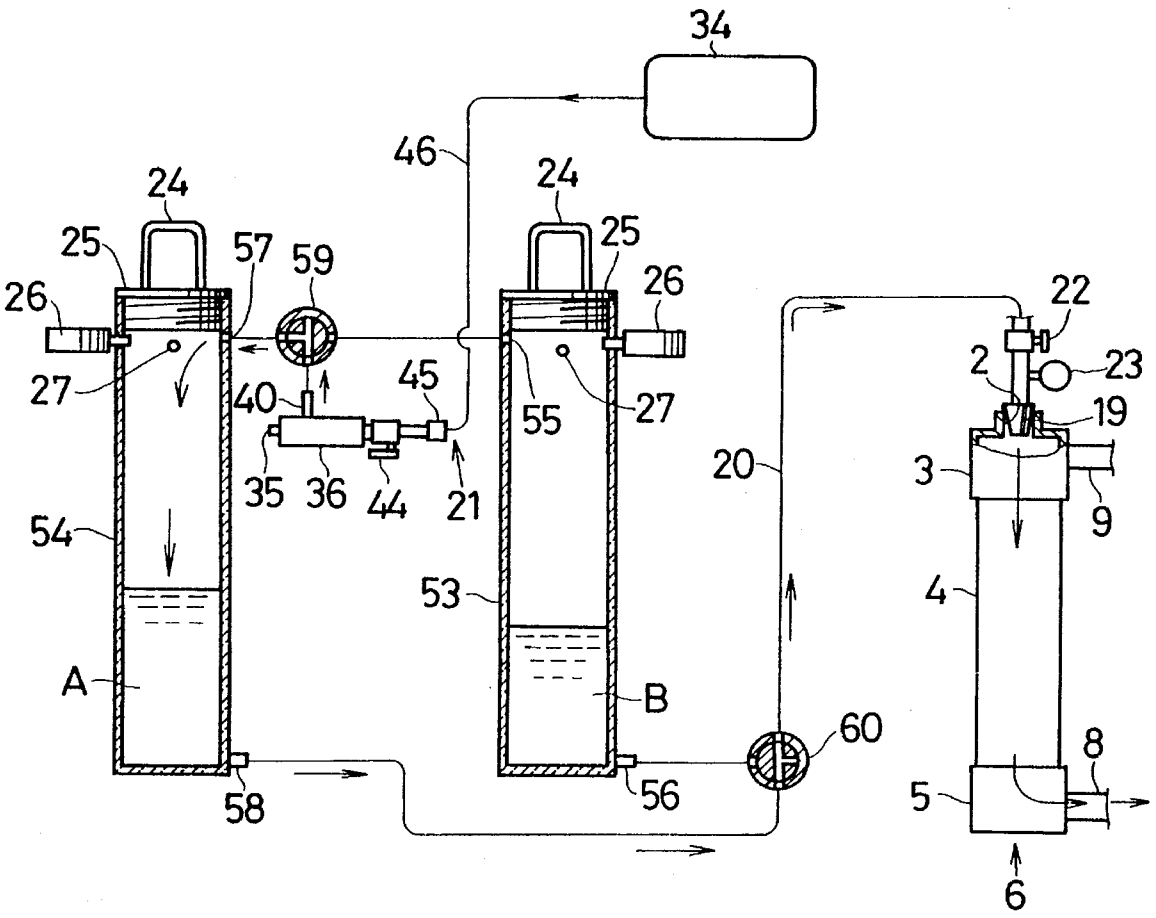
FIG. 12 is an explanatory diagram of fresh liquid feed in the third embodiment.

FIG. 11 and FIG. 12 show a third embodiment of an engine coolant changing apparatus, in which separate tanks 53, 54 are provided, instead of the single tank 18 used for storing both waste liquid B and fresh liquid A in the foregoing embodiments.

That is, the waste liquid tank 53 as waste liquid storing means having a negative pressure action port 55 in the upper part and a liquid inlet 56 in the lower part; and the fresh liquid tank 54 as fresh liquid storing means having a positive pressure action port 57 in the upper part and a liquid outlet 58 in the lower part are disposed separately; and a three-way valve 59 is provided as air passage changeover means among the secondary flow forming pipe 40 of the air ejector 36, negative pressure action port 55, and positive pressure action port 57, so that a negative action may act on the negative pressure action port 55 when discharging waste liquid B by the pressure action means 21, and that a positive pressure may act on the positive pressure action port 57 when feeding fresh liquid A.

Another three-way valve 60 is provided as liquid passage changeover means to communicate the rubber plug 19 and liquid inlet 56 when discharging the coolant, or to communicate the liquid outlet 58 and rubber plug 19 when feeding fresh liquid A. In FIGS. 11 and 12, the same parts as in the preceding drawings are identified with same reference numerals.

The operation of thus constituted third embodiment is explained below by referring to FIGS. 11 and 12.

To discharge the coolant such as LLC in the engine coolant system 1, first, as shown in FIG. 11, the rubber plug 19 is fitted air-tightly to the filler port 2 of the radiator 6, the cock 22 and opening valve 44 are opened, and the air ejector 36 is set in the state same as in FIG. 3, while the secondary flow forming pipe 40 of the air ejector 36 and negative pressure action port 55 are communicated by the three-way valve 59 at the air side, the rubber plug 19 and the liquid inlet 56 of the waste liquid tank 53 are communicated by the three-way valve 60 at the liquid side, and the air compressor 34 is driven to drive the engine in the state of action of negative pressure on the negative pressure action port 55 of the waste liquid tank 53.

In thus engine driven state, when a negative pressure acts in the engine coolant system 1 through the elements 55, 53, 56, 60, 20, 22, and 19, the boiling point of the coolant is lowered, and therefore the coolant in the engine coolant system 1 is overheated to low temperature by the engine heat to boil in an artificial overheat state, and the coolant is pressurized by the generated bubbles, and hence by the negative pressure acting in the waste liquid tank 53, almost all coolant and bubbles in the engine coolant system 1 can be discharged in an extremely short time into the waste liquid tank 53 through the elements 19, 22, 20, 60, and 56.

To feed fresh liquid A in the fresh liquid tank 54 into the engine coolant system 1, on the other hand, the air ejector 36 is set in the state in FIG. 4, the secondary flow forming pipe 40 of the air ejector 36 and the positive pressure action port 57 are communicated by the three-way valve 59 at the air side, the liquid outlet 58 and the rubber plug 19 are communicated by the three-way valve 60 at the liquid side, and the air compressor 34 is driven to apply a positive pressure to the positive pressure action port 57 of the fresh liquid tank 54, so that the fresh liquid A held in a positive pressure is fed into the engine coolant system 1 held in a negative pressure sequentially through the elements 58, 60, 20, 22, and 19, thereby feeding the fresh liquid A promptly in an extremely short time by the pressure difference.

What is more, unlike the prior art, it is not necessary to manipulate the radiator drain cock or jack up the vehicle, and the efficiency of the engine coolant changing job can be enhanced greatly.

In addition, since the coolant storage tanks are separate for waste liquid B and fresh liquid A, the engine coolant changing job can be done in a much shorter time. Other points of the third embodiment are similar to the foregoing embodiments in action and effect, and the corresponding parts in FIGS. 11 and 12 are identified with the same reference numerals in the preceding drawings, and their detailed description is omitted.

(Fourth Embodiment)

Figure 13:
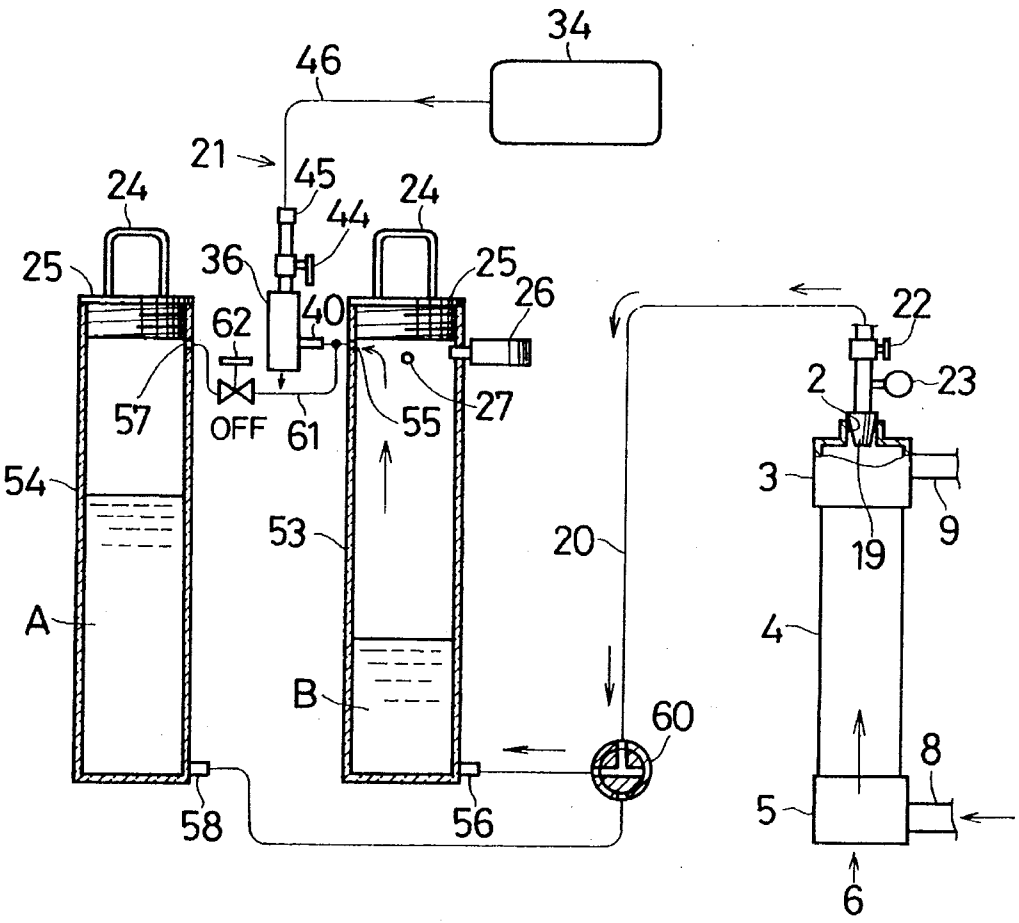
FIG. 13 is an explanatory diagram of coolant discharge in a fourth embodiment of an engine coolant changing apparatus of the invention.
Figure 14:
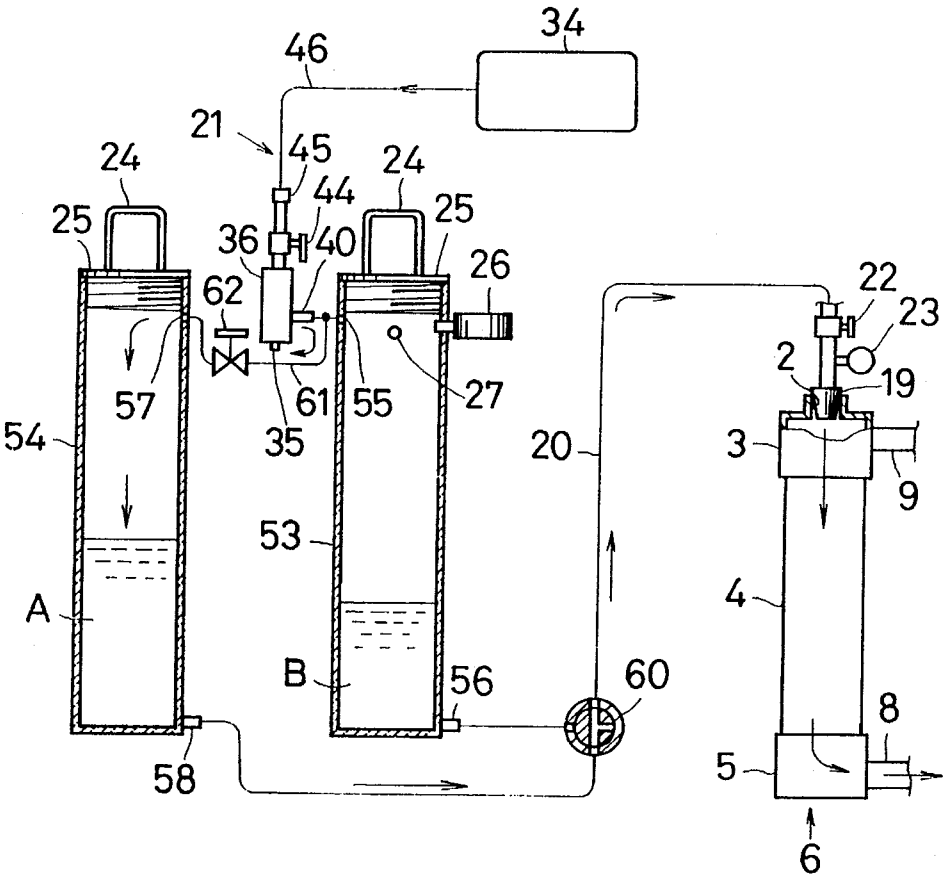
FIG. 14 is an explanatory diagram of fresh liquid feed in the fourth embodiment.

FIGS. 13 and 14 show a fourth embodiment of an engine coolant changing apparatus, in which a pressure meter 26 and a pressure valve 27 are provided only at the waste liquid tank 53 side, although the pressure meter 26 and pressure valve 27 are provided in both waste liquid tank 53 and fresh liquid tank 54 in the third embodiment.

That is, an opening valve 62 is provided in a communicating path 61 for communicating the secondary flow forming pipe 40 of the air ejector 36 and the negative pressure action port 55, and communicating the intersection of the two 40, 55 and the positive pressure action port 57.

Therefore, when discharging the waste liquid B, as shown in FIG. 13, the opening valve 62 is turned off, that is, closed to apply a negative pressure to the negative pressure action port 55, and the coolant in the engine coolant system 1 is discharged into the waste liquid tank 53, and when feeding fresh liquid A, as shown in FIG. 14, the opening valve 62 is turned on, that is, opened to apply a positive pressure to the positive pressure action port 57, and the fresh liquid A in the fresh liquid tank 54 is supplied into the engine coolant system 1 by making use of the pressure difference.

At this time, a positive pressure also acts in the waste liquid tank 53, but since the liquid outlet 56 side is closed by the three-way valve 60, the waste liquid B in the waste liquid tank 53 will not flow out into the engine coolant system 1.

Moreover, the pressure acting in the both tanks 53, 54 can be detected by the single pressure meter 26, and when the internal pressure in the tanks 53, 54 becomes higher than an specific high pressure, the single pressure valve 27 opens to protect the both tanks 53, 54.

In other points, the action and effect are same as in the foregoing embodiments, and the same parts in FIGS. 13 and 14 as in the preceding drawings are identified with same reference numerals, and their detailed description is omitted.

Figure 15:
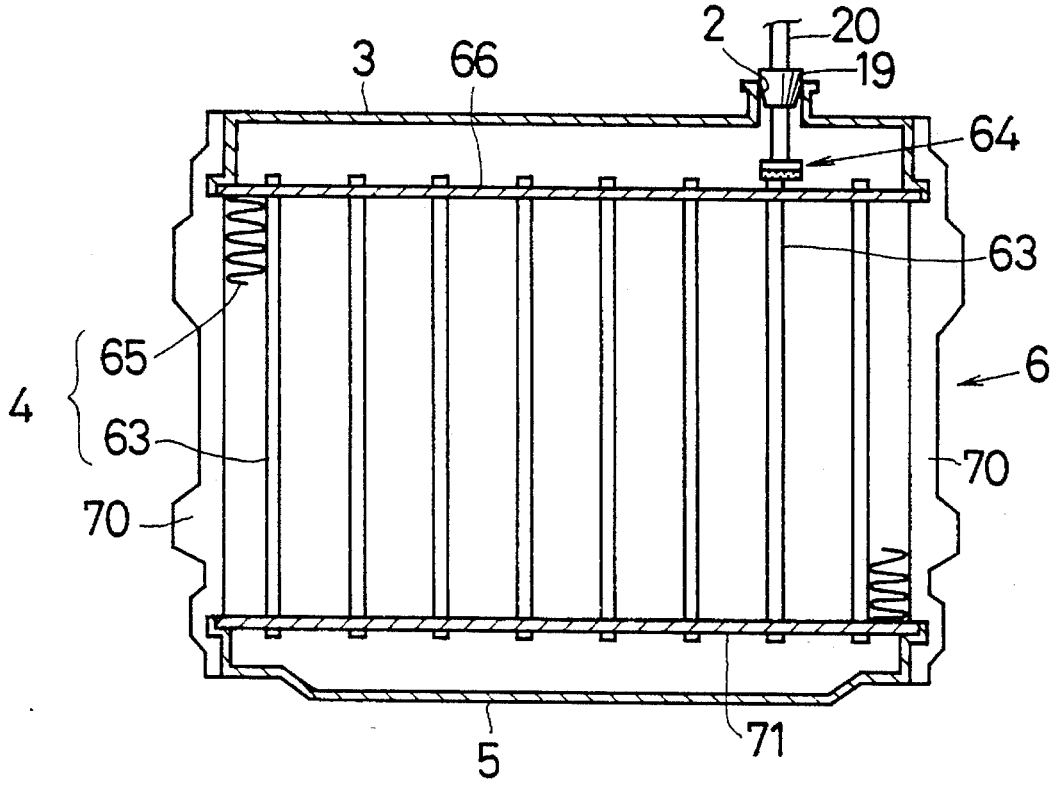
FIG. 15 is an explanatory diagram showing a direct suction member.
Figure 16:
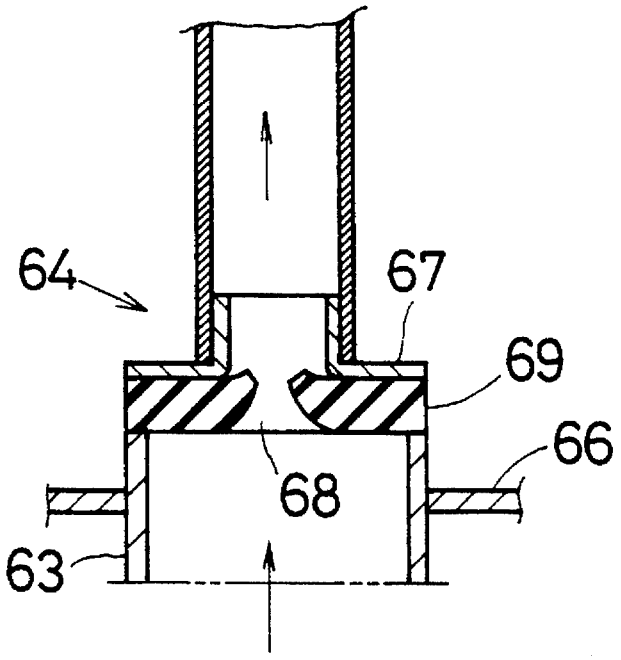
FIG. 16 is a magnified sectional view of essential parts of FIG. 15.

FIGS. 15 and 16 show a direct suction member 64 opened in the upper tank 3 of the radiator 6 when discharging the coolant for sucking the coolant directly from the upper end opening of a water tube 63. The radiator core 4 is composed of a corrugated fin 65 and water tube 63, and the upper end of the water tube 63 projects slightly upward from an upper plate 66, and therefore the direct suction member 64 is communicated with the hose 20 or rubber plug 19, and the coolant is directly sucked from the upper end opening of the water tube 63.

In this embodiment, the direct suction member 64 comprises, as shown in FIG. 16, a hose 66, a linkage member 67, and a rubber or sponge abutting member 69 having an opening 68, and at the time of negative pressure suction, since the coolant is directly sucked from the opening 68 of the abutting member 69 abutting against the upper end opening of the water tube 63, the discharging effect of coolant by negative pressure may be enhanced as compared with the constitution of negative pressure suction of the coolant from the filler port 2 by the rubber plug 19.

In FIG. 15, meanwhile, the rubber plug 19 and direct suction port 64 are used together, but the rubber plug 19 may be omitted. Moreover, in FIGS. 15 and 16, reference numeral 70 denotes a radiator side bracket, and 71 is a lower plate.

Figure 17:
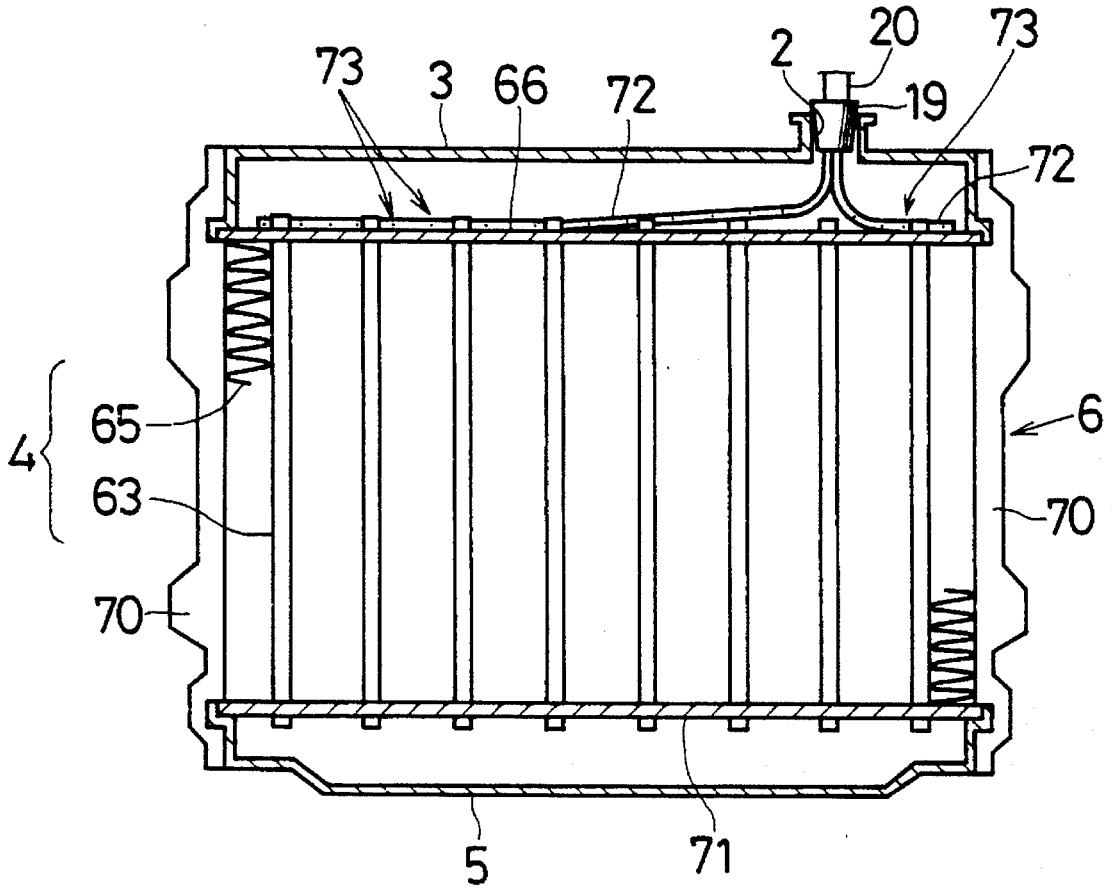
FIG. 17 is an explanatory diagram showing a flexible suction member.

FIG. 17 shows a flexible suction member 72 for sucking the coolant between the water tube 63 projecting into the upper tank 3 of the radiator and the upper plate 66 when discharging the coolant, and a plurality of flexible suction members 72 composed of flexible member such as rubber hose are communicated and linked to the rubber plug 19, and plural suction holes 73 are pierced in the suction members 72.

The flexible suction members 72 are inserted into the upper tank 3 from the filler port 2, and the flexible suction members 72 are laid along on the upper plate 66, and the filler port 2 is shut air-tightly with the rubber plug 19 to apply a negative pressure suction force, while the coolant can be sucked from between the water tube 63 and upper plate 66, so that it is effective to prevent the coolant securely from staying between them (that is, between the upper end opening of the water tube 63 and the top surface of the upper plate 66).

Figure 18:
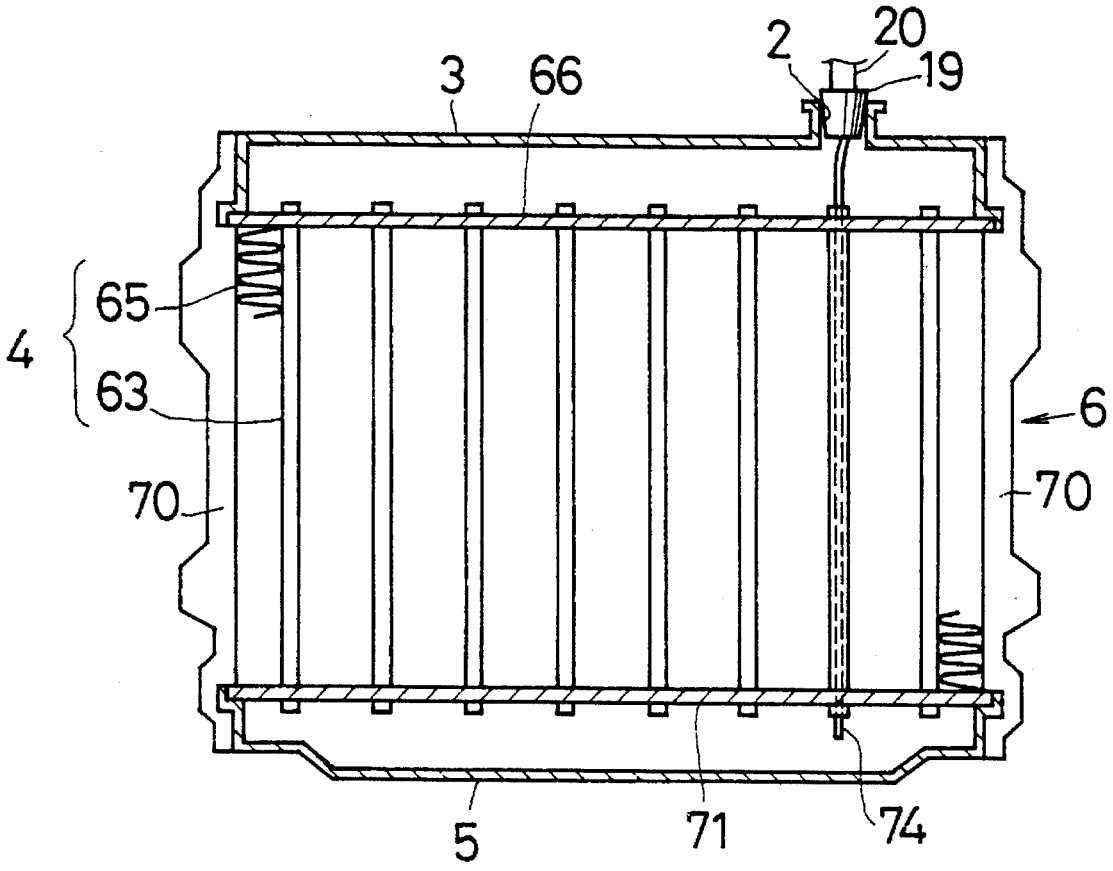
FIG. 18 is an explanatory diagram showing liquid suction means from a lower tank.

FIG. 18 shows suction means for sucking the coolant directly from the lower tank 5 of the radiator 6, in which a tube 74 of a relatively small aperture is communicated and connected to the rubber plug 19, and when this tube 74 is positioned in the lower tank 5 through the water tube 63, the coolant can be directly sucked in from the lower tank 5 at the time of negative pressure suction.

Figure 19:
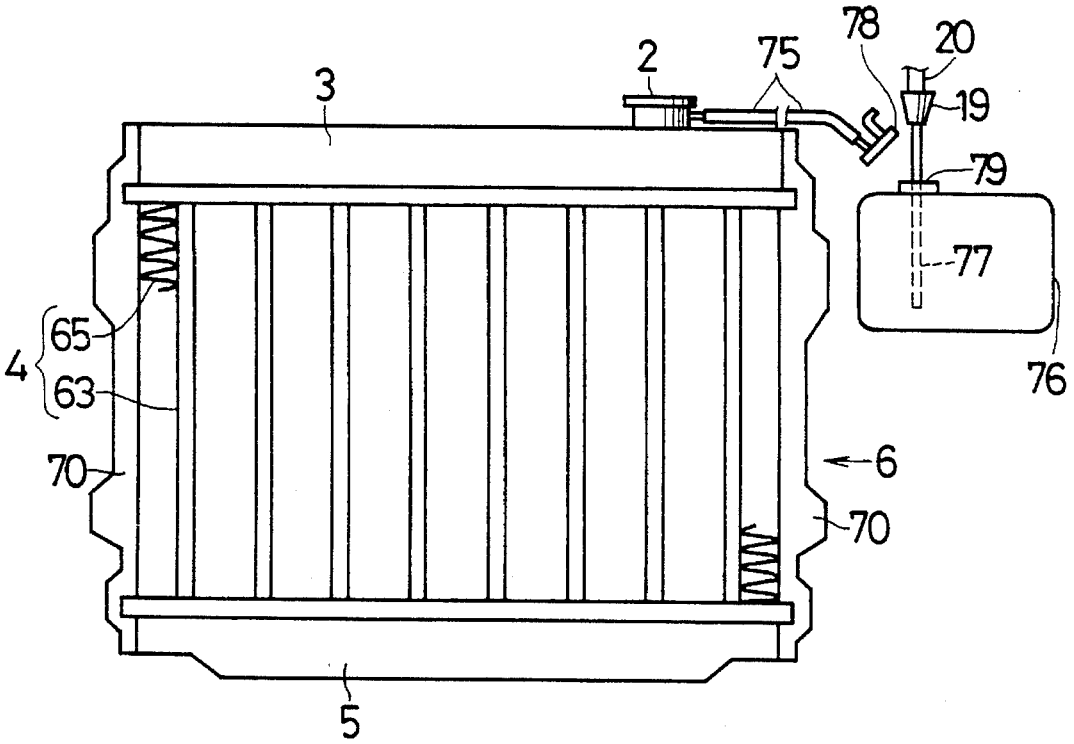
FIG. 19 is an explanatory diagram showing liquid suction means from a reserve tank.

FIG. 19 shows suction means for sucking the coolant in a reserve tank 76 linked through a water sub-tank hose 75 from immediately beneath the filler port 2 of the radiator 6, and a tube 77 is connected to the rubber plug 19, and after dismounting the reserve tank cap 78, when the tube 77 is inserted into the reserve tank 76 from an upper end opening 79, the coolant in the reserve tank 76 is sucked in negative pressure.

In the correspondence between the constitution of the invention and this embodiment;

the coolant storing means of the invention corresponds to the tank 18 in the embodiment; and thereafter similarly;

the detaching means, to the rubber plug 19;

the communicating means, to the hose 20;

the pressure action means, to the air compressor 34, air ejector 36, and baffle pin 35;

the recovery means, to the recovery tank 51;

the recovery passage, to the recovery hose 52;

the passage changeover means, to the three-way valve 50;

the waste liquid storing means, to the waste liquid tank 50;

the fresh liquid storing means, to the fresh liquid tank 54;

the passage changeover means, to the three-way valve 60;

the air compressing means, to the air compressor 34;

the pressure changeover means, to the air ejector 36; and the element for adding resistance to ejection of drive flow, to the baffle pin 35;

however, the invention is not limited to the mentioned constitutions alone.

What is claimed is:

1. An engine coolant changing apparatus comprising:

waste liquid storing means comprising a negative pressure action port and a liquid inlet;

fresh liquid storing means comprising a positive pressure action port and a liquid outlet;

detaching means to be attached to or detached to or from a radiator;

pressure action means for applying a negative pressure to said negative pressure action port of said waste liquid storing means to overheat the coolant to a low temperature by driving an engine when discharging the coolant from an engine coolant system, and for applying a positive pressure to said positive pressure action port of said fresh liquid storing means when feeding a fresh liquid; and communicating means for communicating between the detaching means and the liquid inlet of said waste liquid storing means when discharging the coolant, and for communicating between the liquid outlet of said fresh liquid storing means and the detaching means when feeding fresh liquid; wherein said pressure action means comprises a plurality of flexible suction members for sucking the coolant between a water tube projecting into a radiator upper tank and an upper plate when discharging the coolant, wherein the plurality of flexible suction members communicate with said detaching means.

2. An engine coolant changing apparatus comprising:

waste liquid storing means for storing waste coolant and comprising a negative pressure port and a liquid inlet;

fresh liquid storing means for storing fresh coolant and comprising a positive pressure port and a liquid outlet;

tube means for connecting said liquid outlet of said fresh liquid storing means and said liquid inlet of said waste liquid storing means to a radiator of an engine coolant system;

pressure means for producing a negative pressure during a discharging operation and a positive pressure during a charging operation while concurrently maintaining a negative pressure in said engine coolant system;

first connecting means for connecting said pressure means to said negative pressure port of said waste liquid storing means during said discharging operation and to said positive pressure port of said fresh liquid storing means during said charging operation;

second connecting means for connecting said tube means to said liquid inlet of said waste liquid storing means during said discharging operation and to said liquid outlet of said fresh liquid storing means during said charging operation, whereby said negative pressure is supplied to overheat coolant to a low temperature by driving an engine when discharging the coolant from the engine coolant system, and wherein during charging operation negative pressure is concurrently maintained in the engine coolant system while positive pressure is applied by said pressure means so that said fresh liquid coolant is more rapidly charged into the engine coolant system by the combined positive pressure acting on the fresh liquid coolant in the fresh liquid storing means and the negative pressure remaining in the engine coolant system.

* * * * *